US011060411B2

(12) United States Patent
Urac et al.

(10) Patent No.: US 11,060,411 B2
(45) Date of Patent: Jul. 13, 2021

(54) INNER SHROUD ASSEMBLY FOR STATOR VANES

(71) Applicant: PRATT & WHITNEY CANADA CORP., Longueuil (CA)

(72) Inventors: Tibor Urac, Mississauga (CA); Barry Barnett, Unionville (CA); Matthew Meschino, Woodbridge (CA)

(73) Assignee: PRATT & WHiTNEY CANADA CORP., Longueuil (CA)

( * ) Notice: Subject to any disclaimer, the term of this patent is extended or adjusted under 35 U.S.C. 154(b) by 0 days.

(21) Appl. No.: 16/672,023

(22) Filed: Nov. 1, 2019

(65) Prior Publication Data

US 2020/0300101 A1 Sep. 24, 2020

Related U.S. Application Data

(60) Provisional application No. 62/822,332, filed on Mar. 22, 2019.

(51) Int. Cl.
*F01D 5/30* (2006.01)

(52) U.S. Cl.
CPC ..... *F01D 5/30* (2013.01); *F05D 2220/30* (2013.01); *F05D 2240/12* (2013.01)

(58) Field of Classification Search
CPC . F01D 5/30; F01D 5/282; F01D 5/284; F01D 11/003; F01D 11/005; F01D 25/243; F01D 5/225; F01D 9/042; F05D 2220/30; F05D 2240/12; F05D 2300/431; F05D 2300/603; F05D 2300/437; F05D 2240/11; F05D 2300/43; F05D 2260/30
See application file for complete search history.

(56) References Cited

U.S. PATENT DOCUMENTS 4,736,865 A * 4/1988 Rericha ..... F02B 77/005 220/233
4,940,386 A 7/1990 Feuvrier
5,562,419 A * 10/1996 Crall ..... F01D 5/225 416/190

(Continued)

FOREIGN PATENT DOCUMENTS

EP 0250324 A1 12/1987
EP 0277884 A2 8/1988
EP 1762704 A2 3/2007

*Primary Examiner* — Jacob M Amick
*Assistant Examiner* — Charles J Brauch
(74) *Attorney, Agent, or Firm* — Norton Rose Fulbright Canada LLP

(57) ABSTRACT

A gas turbine engine assembly comprises a casing defining a gas path, the casing including a shroud having an annular body having a surface defining a portion of gas path, the shroud having slots configured for receiving inserted vanes. The slots are delimited substantially about their perimeter by respective flanges, the flanges radially offset from the shroud gas path surface so as to be disposed outside of said gas path, the flanges defined by opposed flange surfaces. Vanes received in the slots. Grommets engage the vanes at the slots. Inserts extend between the shroud and the grommets, the inserts having slots configured for engaging both of the opposed flanges, the inserts extending in a radial direction from at least the respective flange to an adjacent said shroud gas path surface to substantially matchingly mate with an inner surface the adjacent shroud gas path surface.

19 Claims, 2 Drawing Sheets

(56) References Cited

U.S. PATENT DOCUMENTS

| | | | | |
|---|---|---|---|---|
| 6,619,917 | B2 | 9/2003 | Glover | |
| 7,413,400 | B2 | 8/2008 | Barnett | |
| 7,494,316 | B2 * | 2/2009 | Barnett | F01D 9/042 415/119 |
| 7,530,782 | B2 | 5/2009 | Barnett | |
| 7,628,578 | B2 * | 12/2009 | Barnett | F01D 9/042 415/119 |
| 9,840,929 | B2 * | 12/2017 | Barnett | F01D 9/042 |
| 2004/0111829 | A1 | 6/2004 | Bruno et al. | |
| 2014/0356158 | A1 | 12/2014 | Barnett | |

* cited by examiner

INNER SHROUD ASSEMBLY FOR STATOR VANES

TECHNICAL FIELD

The application relates generally to gas turbine engines and, more particularly, to insertable stator vanes.

BACKGROUND OF THE ART

Gas turbine engines have an engine core, and an annular flow passage disposed therebetween. Vanes are typically used to reduce or increase the swirl in the air flow within the engine. The vanes may be individually radially insertable into corresponding slots or other retention means in the case.

To minimize air leakage between the inserted vane and the case, a grommet may be disposed between the surface of the inner shroud and the vane. Room for improvement exists in the art relating to insertable vanes.

SUMMARY

In one aspect, there is provided a gas turbine engine assembly comprising: a casing defining a gas path, the casing including a shroud having an annular body having a surface defining a portion of gas path, the shroud having slots configured for receiving inserted vanes, the slots delimited substantially about their perimeter by respective flanges, the flanges radially offset from the shroud gas path surface so as to be disposed outside of said gas path, the flanges defined by opposed flange surfaces; vanes received in the slots, grommets engaging the vanes at the slots, and inserts extending between the shroud and the grommets, the inserts having slots configured for engaging both of the opposed flanges, the inserts extending in a radial direction from at least the respective flange to an adjacent said shroud gas path surface to substantially matchingly mate with an inner surface the adjacent shroud gas path surface.

In another aspect, there is provided a gas turbine engine comprising: an annular inner shroud defining a shroud gas path surface, slots distributed in the annular inner shroud and delimited by a radially inward projection offset from the shroud gas path surface, vanes received in the slots to project outwardly from the annular inner shroud, grommets engaging the vanes at the slots, and inserts between the shroud and the grommets, the insert engaging both sides of the radially inward projection, the inserts forming a smooth gas path transition with the shroud gas path surface.

DESCRIPTION OF THE DRAWINGS

Reference is now made to the accompanying figures in which.

DETAILED DESCRIPTION

Figure 1:
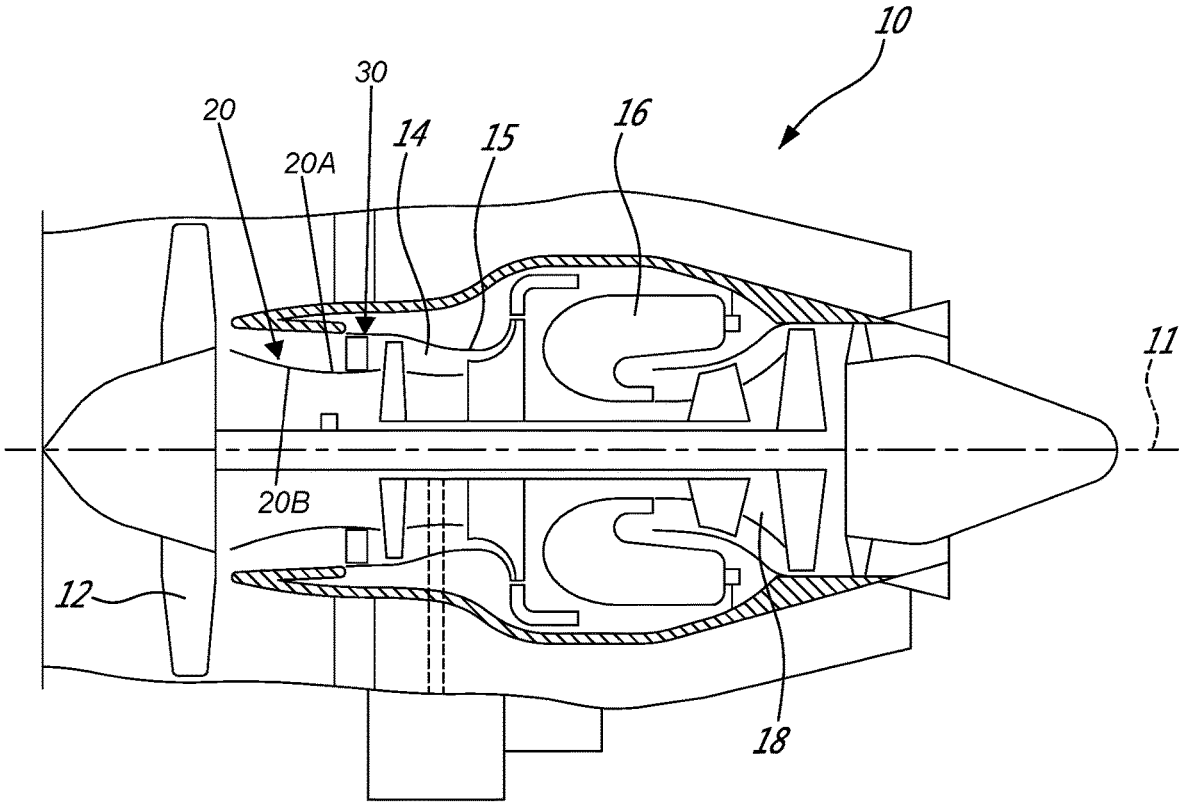
FIG. 1 is a schematic cross-sectional view of a gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air within a compressor case 15, a combustor 16 in which the compressed air is mixed with fuel and ignited for generating an annular stream of hot combustion gases, and a turbine section 18 for extracting energy from the combustion gases. A longitudinal axis of the gas turbine engine 10 is shown as 11. In an embodiment, the various rotating components of the compressor 14 and of the turbine 18 rotated about the longitudinal axis 11, or about axes parallel to the longitudinal axis 11.

Figure 2:
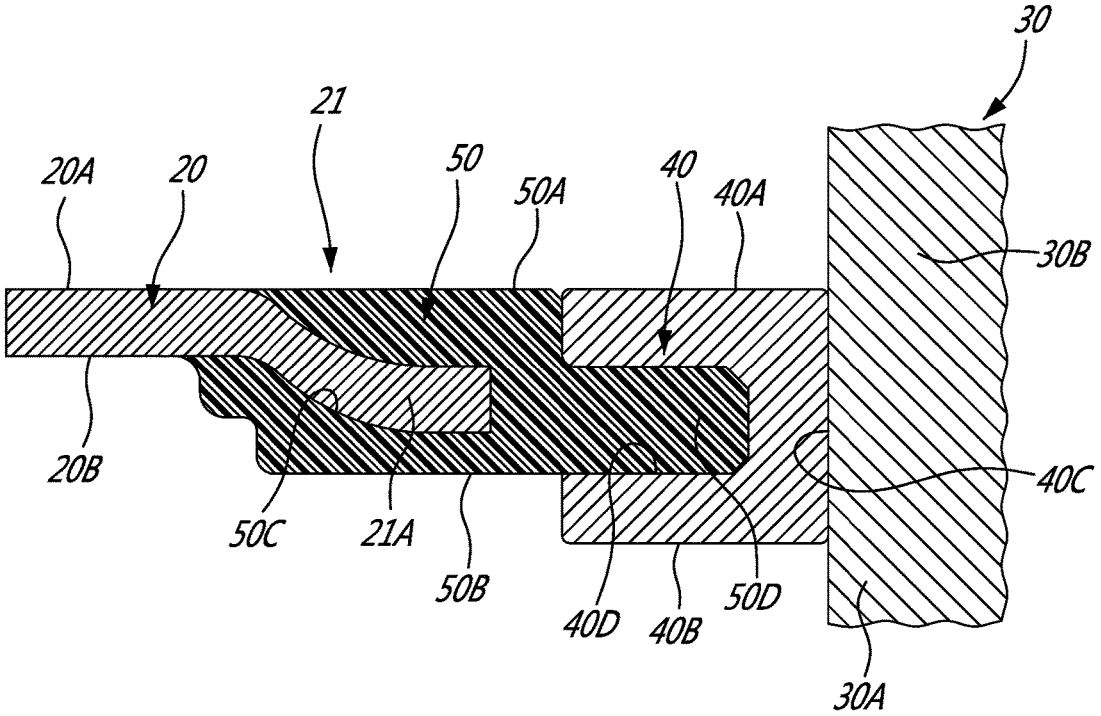
FIG. 2 is a cross-sectional view of an inner shroud assembly in accordance with the present disclosure.

Referring to FIG. 2, an inner shroud assembly in accordance with the present disclosure is shown, and may include an inner shroud 20, vanes 30, grommets 40, and inserts 50:

- The inner shroud 20 is an annular body that may surround the longitudinal axis 11, with a central axis of the annular body being generally parallel and/or collinear with the longitudinal axis 11. The inner shroud 20 may also be referred to as inner case, for example. The inner shroud 20 forms a gas path with the compressor case 15 or other components, and preserves a distance between the vanes 30.
- The vanes 30 extend in the gas path, and interact with the gas flow. For example, the vanes 30 may reduce or increase the swirl in the air flow within the engine 10.
- The grommets 40 are an interface between the vanes 30 and the inner shroud 20. The grommets 40 are in a sealing relation with the vanes 30 so as to limit fluid leakage between the inner shroud 20 and the vanes 30.
- The inserts 50 are another interface between the vanes 30 and the inner shroud 20. The inserts 50 are in a sealing relation with the inner shroud 20 and the grommets 40 also to limit fluid leakage between the inner shroud 20 and the vanes 30. Moreover, the inserts 50 may assist in preserving a continuous gas path surface at the inner shroud 20.

Figure 3:
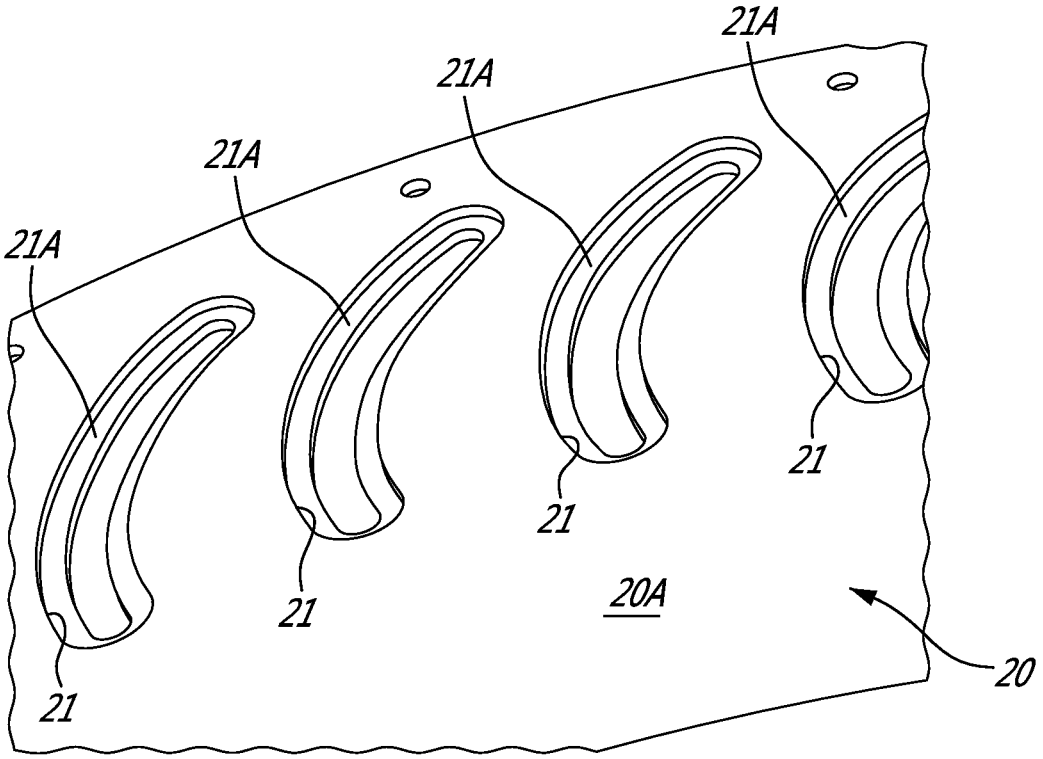
FIG. 3 is a perspective view of an inner shroud of the inner shroud assembly of FIG. 2.

In the embodiment shown, the inner shroud 20 may have an annular wall, made of a single annular body, or of interconnected segments, as one possible example. The inner shroud may be made of thermoformed polymer composite materials or like polymers. Other materials may include metal (e.g., sheet metal), ceramics, composites, etc. In an embodiment, the inner shroud 20 is made of two or more superposed layers, to from parts such as a flange in a slot, as described below. Layers may be interconnected by thermoplastic welding or bonding. The inner shroud 20 has a gas path surface 20A delimiting the annular flow path with the compressor case 15, and an opposite inner surface 20B. The gas path surface 20A is oriented radially outwardly. Referring to FIGS. 2 and 3, vane-receiving slots 21 are defined through the annular wall. The vane-receiving slot 21 may be circumferentially distributed about the circumference of the inner shroud 20, for example equidistantly spaced or not. In an embodiment, all slots 21 have the same outline. The vane-receiving slots 21 may each be delimited by a flange 21A. As observed from FIG. 2, the flanges 21A are offset relative to the gas path surface 20A. In other words, a shoulder, a lip or like depression or discontinuity is formed from the surrounding gas path surface 20A. The flanges 21A may be a gradual or continuous inward depression, as shown in FIG. 2, or may be a stepped depression as well, as in FIG. 3.

The stator vanes 30 may project outwardly from the inner shroud 20, across the annular flow path to the compressor case 15 (FIG. 1). The stator vanes 30 may be located elsewhere, such as in the by-pass duct, downstream of the fan 12, as an example. In an embodiment, the stator vanes 30 are radially oriented relative to the inner shroud 20. In a particular embodiment, each stator vane 30 may have a tip region or head retained by the case 15 (FIG. 1), a root region 30A received inside the inner shroud 20, and an airfoil portion 30B extending from the root region 30A toward the tip region. According to an embodiment, the root region 30A is a continuation in cross-section of the airfoil portion 30B. The stator vanes 30 may float relative to the inner shroud 20, i.e., they may not be rigidly connected to the inner shroud 20. In such a scenario the stator vanes 30 are fixed to the case 15 by their heads.

Referring to FIG. 2, one of the grommets 40 is shown. In an embodiment, all grommets 40 have a same shape. The grommets 40 have an annular body, to surround the vanes 30, i.e., one grommet 40 per vane 30. The grommets 40 have a generally flat gas path surface 40A, and an opposite inner surface 40B, with a vane-contacting surface 40C between. Consequently, the grommets 40 may define an annular channel 40D. In an embodiment, the annular channel 40D gives a U-shaped cross section to the grommet 40, though other cross-sections are contemplated as well, such as l-shape. Depending on the point of view, the cross section may also be called a lateral U-shape, an inverted U-shape, U-shape facing away from the vanes 30. Other cross-sectional shapes are considered, such as L-shape, square section, circular section, to name a few. The U-shaped cross section may entail a deeper cavity for the annular channel 40D than a thickness of a web to which is part the vane-contacting surface 40C.

In an embodiment, the grommets 40 are made of an elastomeric material providing some sealing capacity. The elastomeric materials include polymers, rubbers, silicones, and like elastic materials. The materials are selected to withstand exposure to the pressures and temperatures of the gas turbine engine 10. The elastic deformation range of the grommets 40 may therefore ensure that the vane-contacting surface 40C of each grommet 40 is in a tight sealing fit with a respective vane 30, free of gap. In an embodiment, there may be some sliding capacity between the vane-contacting surface 40C of the grommet 40 and the vane 30, the grommet 40 moving along the vane 30. The grommet 40 may be located at the root region 30A and/or at the airfoil portion 30B.

Figure 4:
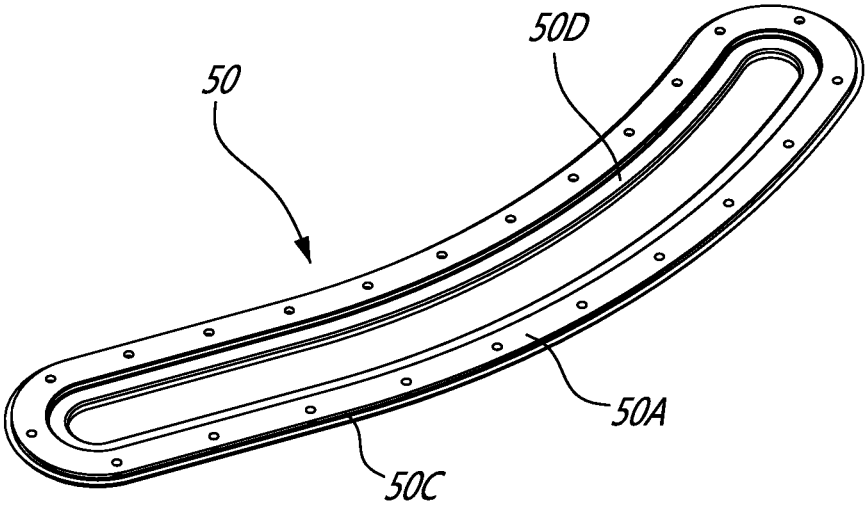
FIG. 4 is a perspective view of an exemplary insert of the inner shroud assembly.

Referring to FIGS. 2 and 4, the insert 50 is illustrated. As it is the interface between the inner shroud 20 and the grommet 40, the contour of the insert 50 is generally similar to that of the slots 21 of the inner shroud 20. In an embodiment, all inserts 50 have a same shape. The inserts 50 have an annular body, to surround and support the grommets 40, i.e., one insert 50 per grommet 40. In another embodiment, the inserts 50 may be constituted of segments as well. The inserts 50 have a generally flat gas path surface 50A, and an opposite inner surface 50B. The inserts 50 may define an annular channel 50C between the gas path surface 50A and the opposite inner surface 50B. In an embodiment, the annular channel 50C gives a U-shaped cross section (e.g., lateral U-shape, an inverted U-shape defining on point of view, facing away from the vanes 30) to part of the insert 50, though other cross-sections are contemplated as well, A grommet-interface flange 50D may project radially inwardly, for example from a base of the U-shaped cross section. The U-shaped cross section may entail a deeper cavity for the annular channel 50C than a thickness of a base of the U-shaped cross-section. In FIG. 4, holes may be seen on a surface of the inserts 50. These holes may optionally be present to increase a mechanical connection between the insert 50 and the grommet 40, for instance when overmolded or comolded.

As observed from FIG. 2, the annular channel 50C may have a shape that is complementary to that of the flange 21A in the inner shroud 20. The insert 50 may for example be bonded to the inner shroud 20, and the complementary shape may increase the surface area between the insert 50 and the inner shroud 20. Consequently, as shown in FIG. 2, the gas path surfaces 20A, 40A and 50A are side by side when the inner shroud assembly is assembled. The gas path surfaces 20A, 40A and 50A may from a continuous and smooth planar surface leading to the vane 30. Though the expressions flat and/or planar are used herein, the inner shroud 20 is an annular body relative to the longitudinal axis 11, whereby the gas path surface 20A may not be perfectly flat, it may be arcuate, and feature an arcuate plane. The expressions continuous and/or smooth may indicate that there is no significant step or protuberance in the transition between the gas path surfaces 20A, 40A and/or 50A. A joint line may be present at the transition between the gas path surfaces 20A, 40A and/or 50A, notably as materials are different.

Also as observed from FIG. 2, the grommet 40 and the insert 50 are interconnected to one another. For example, as shown, the grommet-interface flange 50D of the insert 50 may be received in the annular channel 40D of the grommet 40. The fit between these components may be a tight fit, an interface fit, etc. Adhesives may be used to interconnect the grommets 40 to the inserts 50. In another embodiment, the grommets 40 and inserts 50 are comolded.

In an embodiment, the inserts 50 are made of a plastomeric or elastomeric material providing some sealing capacity. The materials include thermoplastic composite materials and like polymers, or ceramics, and metals. The inserts 50 may be compression molded, injection molded, or may result from additive manufacturing. For example, the insert 50 may have a monoblock molded body. The materials are selected to withstand exposure to the pressures and temperatures of the gas turbine engine 10. The material of the inserts 50 may be selected to have a greater rigidity and/or hardness than the material of the grommets 40. In an embodiment, this may entail the same material, but at different densities. Accordingly, the inserts 50 serve as a structure for the grommets 40, ensuring that the grommets 40 generally retain their shape, for instance to keep the gas path surface 40A continuous with the gas path surfaces 20A and 50A and hence form a continuous and smooth gas path surface. In particular, the illustrated embodiment featuring the penetration of the inserts 50 into the grommets 40 ensures that part of the gas path surface 40A is backed by the grommet-interface flange 50D, or like projecting member of the insert 50. The portion of the gas path surface 40A that is backed by the grommet interface flange 50D is greater than a portion of the gas path surface 40A that is not backed.

The illustrated embodiment of FIG. 2 between the grommet 40 and insert 50 features one contemplated geometry among others. In another embodiment, the grommet 40 may be an O-ring or the like inserted into an annular channel of the insert 50, such that the gas path surface is defined by the gas path surfaces 20A and 50A (no gas path surface 40A). In another embodiment, the grommet 40 has a rectangular section with flat gas path surface 40A, that is adhered onto the base of the U-shape of the insert 50. The mechanical forces of the joint between the grommet 40 and insert 50 may provide the structural integrity for the grommet 40 to preserve its shape. In another embodiment, it is the insert 50 that is comolded with the inner shroud 20 (e.g., the inner shroud 20 made of assembled segments), with the grommet 40 installed subsequently.

The above description is meant to be exemplary only, and one skilled in the art will recognize that changes may be made to the embodiments described without departing from the scope of the invention disclosed. For example, the invention can be applied to any suitable insertable vanes, such as low or high pressure compressors. Still other modifications which fall within the scope of the present invention will be apparent to those skilled in the art, in light of a review of this disclosure, and such modifications are intended to fall within the appended claims.

The invention claimed is:

1. A gas turbine engine assembly, comprising:

a casing defining a gas path, the casing including a shroud having an annular body having a shroud gas path surface defining a portion of the gas path, the shroud having slots configured for receiving inserted vanes, each of the slots delimited substantially about a perimeter thereof by a flange of the shroud, the flanges of the shroud radially offset from the shroud gas path surface so as to be disposed outside of the gas path;

vanes received in the slots, grommets engaging the vanes at the slots, and inserts extending between the shroud and the grommets, each of the inserts having a slot configured for engaging one of the flanges of the shroud, each of the inserts having a member at an axial end of each insert closest to the vanes, the member extending into one of the grommets, each of the inserts extending in a radial direction from said flange to adjacent the shroud gas path surface to substantially matchingly mate with the adjacent shroud gas path surface.

2. The gas turbine engine assembly according to claim 1, wherein the annular body of the shroud is a polymeric body.

3. The gas turbine engine assembly according to claim 2, wherein the annular body is constituted of shroud segments.

4. The gas turbine engine assembly according to claim 1, wherein the inserts and the grommets have gas path surfaces, a smooth gas path transition including a sequence of the gas path surfaces of the inner shroud, of the inserts, and of the grommets, the smooth gas path transition being free of radial protuberances from the gas path surfaces of the shroud, of the inserts, and of the grommets.

5. The gas turbine engine assembly according to claim 1, wherein the grommets have an annular body with a U-shaped section facing away from the vane.

6. The gas turbine engine assembly according to claim 5, wherein the members of the inserts are received in an annular channel of the U-shaped section.

7. The gas turbine engine assembly according to claim 1, wherein the inserts have an annular body with a U-shaped section facing away from the vane.

8. The gas turbine engine assembly according to claim 7, wherein the flanges of the shroud are received in an annular channel of the U-shaped section of the insert.

9. The gas turbine engine assembly according to claim 8, wherein the flanges are bonded to a surface of the annular channel of the U-shaped section of the insert.

10. The gas turbine engine assembly according to claim 1, wherein the inserts have a monoblock polymeric body.

11. The gas turbine engine assembly according to claim 1, wherein the grommets have a greater elasticity than the inserts.

12. The gas turbine engine assembly according to claim 1, wherein pairs of the grommet and of the vane form sliding joints.

13. The gas turbine engine assembly according to claim 1, wherein the member of each of the inserts is a flange, the grommets engage both sides of the flange of the inserts, the flange of the inserts being offset from a gas path surface of the insert, the grommet configured to provide a smooth gas path transition between the gas path surface of the insert and the grommet.

14. A gas turbine engine, comprising:

an annular inner shroud defining a shroud gas path surface, slots distributed in the annular inner shroud and delimited by a radially inward projection offset from the shroud gas path surface;

vanes received in the slots to project outwardly from the annular inner shroud;

grommets engaging the vanes at the slots; and inserts between the shroud and the grommets, the insert engaging both sides of the radially inward projection, the inserts having members at an axial end of each insert closest to the vanes, the members extending into the grommets, the inserts forming a smooth gas path transition with the shroud gas path surface.

15. The gas turbine engine according to claim 14, wherein the grommets have an annular body with a U-shaped section facing away from the vane, the members of the inserts received in an annular channel of the U-shaped section.

16. The gas turbine engine according to claim 15, wherein the inserts have an annular body with a U-shaped section facing away from the vane, the radially inward projections of the inner shroud received in an annular channel of the U-shaped section of the insert.

17. The gas turbine engine according to claim 16, wherein the flanges are bonded to a surface of the annular channel of the U-shaped section of the insert.

18. The gas turbine engine according to claim 14, wherein the members of the inserts are flanges, the grommets engage both sides of the flanges, the flanges being offset from a gas path surface of the insert, the grommet configured to provide a smooth gas path transition between the gas path surface of the insert and the grommet.

19. A gas turbine engine, comprising:

an annular inner shroud defining a shroud gas path surface, slots distributed in the annular inner shroud and delimited by axial ends of the shroud;

vanes received in the slots to project outwardly from the annular inner shroud;

grommets engaging the vanes at the slots and defining a grommet gas path surface; and inserts between the shroud and the grommets, the inserts engaging the axial ends of the shrouds, the inserts having flanges at axial ends of the inserts closest to the vanes, the flanges being offset from an insert gas path surface of the inserts, the flanges extending into the grommets and the grommets engaging both sides of the flanges, the annular inner shroud, the inserts and the grommets forming a smooth gas path transition between the shroud gas path surface, the grommet gas path surface and the insert gas path surface.

* * * * *